United States Patent [19]

Gherardi et al.

[11] Patent Number: 4,785,832

[45] Date of Patent: Nov. 22, 1988

[54] DEVICE FOR DIVIDING A CONTINUOUS WEB OF WRAPPING MATERIAL INTO SUCCESSIVE SINGLE SECTIONS

[75] Inventors: Gian L. Gherardi, Medicina; Valter Spada, Bologna, both of Italy

[73] Assignee: SASIB S.p.A., Bologna, Italy

[21] Appl. No.: 916,733

[22] Filed: Oct. 8, 1986

[30] Foreign Application Priority Data

Oct. 30, 1985 [IT] Italy ..... 12592 A/85

[51] Int. Cl.[4] ..... A24C 5/56

[52] U.S. Cl. ..... 131/94; 131/95; 83/348

[58] Field of Search ..... 131/94, 95; 83/348

[56] References Cited

U.S. PATENT DOCUMENTS 3,209,633 10/1965 Gherardi ..... 83/348

4,640,165 2/1987 McMahon ..... 83/348

*Primary Examiner*—V. Millin

*Assistant Examiner*—Joe H. Cheng

*Attorney, Agent, or Firm*—Spencer & Frank

[57] ABSTRACT

A device for dividing a continuous web of wrapping material into successive single sections of the same length, particularly for dividing a web of wrapping material into successive single bands used in the manufacture of filter-tipped cigarettes. The device includes a rotary cutting roller with one or more angularly equispaced peripheral radial blades, the cutting edge of which is parallel to the axis of a shaft for driving in rotation the said cutting roller (1). The blade or blades are each secured to a bridge-shaped blade-carrying member which by elastic deformation is elastically yieldable in the radial direction and can be completely or partly made from the skirt of the cutting roller fastened to the roller or from a block added and secured to the skirt.

17 Claims, 3 Drawing Sheets

DEVICE FOR DIVIDING A CONTINUOUS WEB OF WRAPPING MATERIAL INTO SUCCESSIVE SINGLE SECTIONS

BACKGROUND OF THE INVENTION

The invention refers to the devices for dividing a continuous web of wrapping material into successive single sections of the same length, particularly for dividing a web of wrapping material into successive single bands used in the manufacture of filter-tipped cigarettes.

In particular, the invention refers to a device of the above-mentioned type embodied according to the leading principle of the European patent application No. 86103332 and comprising a rotary cutting roller with one or more angularly equispaced peripheral radial blades, the cutting edge of which is parallel to the axis of the shaft for driving in rotation the said cutting roller, and a rotary counter-roller having one or more peripheral anvils that cooperate each with one blade on the cutting roller, and which is possibly provided with suction ports for holding onto the counter-roller the single sections cut from the web fed around the counter-roller between the latter and the cutting roller, the blade being or blades secured each to a blade-carrying member which by elastic deformation is elastically yieldable in the radial direction toward the axis of the shaft for driving in rotation the cutting roller and which is integral with the cutting roller itself.

In the device described by way of example in the said European patent application No. 86103332, each blade-carrying member is composed of a projecting portion and it is therefore statically comparable to a beam fixed at one end.

Though perfectly meeting the purpose and fully satisfactory solving the problem at the basis of the European patent application No. 86103332, the said type of projecting blade-carrying member shows some inconveniences, such as a considerable mechanical stress of its area of connection to the cutting-roller skirt and a sensitivity to vibrations, to eliminate which means of radial preloading and/or damping elastic supports are required.

SUMMARY OF THE INVENTION

The present invention eliminates these inconveniences by the fact that each blade-carrying element is manufactured like a bridge that is supported at both ends by the cutting-roller and it is therefore comparable to a beam laying or fixed at both ends. Thanks to this solution providing for bridge-shaped blade-carrying members, the areas connecting the latter to their support prove to be less stressed than those of projecting blade-carrying members, and their fatigue strength is greater. Moreover, since the bridge-shaped blade-carrying member may present a symmetric configuration, i.e., it can be loaded at its middle by the respective blade centrally mounted, it is balanced and practically insensitive to vibrations. Consequently, special preloading and/or elastic-support means can be avoided, thus achieving a considerable constructive simplification.

Also, the bridge-shaped blade-carrying members according to the present invention can be made of one piece with the cutting roller skirt, providing special cavities in the skirt of the said roller parallely to its axis, or they can be made separately and added and peripherally secured onto the cutting roller itself.

BRIEF DESCRIPTION OF THE DRAWINGS

Some embodiments of the blade-carrying member according to the invention are shown by way of example in the enclosed drawings and will be described hereinafter. In the drawings.

DESCRIPTION OF THE PREFERRED EMBODIMENTS

Figure 1:
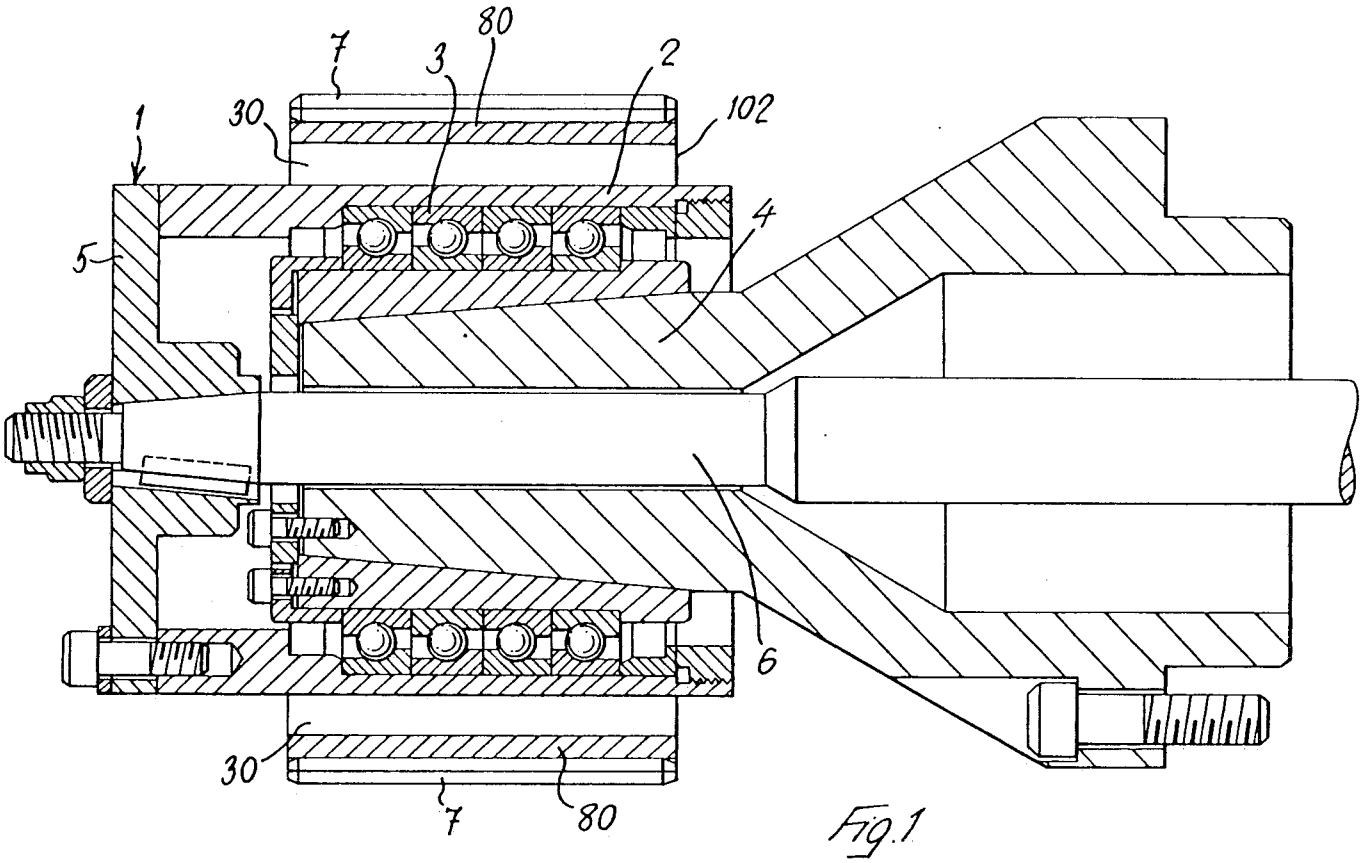
FIG. 1 is a longitudinal sectional view of the cutting roller.

In the figures, numeral 1 denotes the cutting roller unit of a device for dividing a continuous web of wrapping material into successive single sections of a same length. The cutting roller 1 comprises a cylindrical skirt 2 which through bearings 3 is mounted onto a cantilevered fixed support 4. The skirt 2 has its outward end secured to a disk 5 which in turn is secured to a driving shaft 6 rotatably mounted in support 4.

On its periphery, the cutting roller 1 carries a plurality of blades 7 which are parallel to the axis of the skirt 2 and are set in an angularly equispaced relation. Each blade 7 is fastened to a blade-carrying member such as a blade-carrying member 80,81, 82 or 83 in accordance with the respective embodiments illustrated in FIGS. 2, 3, 4 and 5. For this purpose, on its outward side, each blade-carrying member is provided with a housing for seating therewith the respective blade 7, that has a square profile with four cutting edges. It is then possible to change the active cutting edge of blade 7 by inserting in a different angular position the blade 7 into the respective housing in the blade-carrying member. Each blade 7 can be fastened to the respective blade-carrying member 80,81,82, or 83 by means of two resilient platelets 13 (or by means of analogous clamping rigid stirrups) which through screws 12 are secured to the blade-carrying member, and partially overlap the blade 7, as shown in FIGS. 2 to 5.

The blade-carrying members 80,81,82 and 83 are elastically yieldable in the radial direction. To this end, the blade-carrying members 80,81 and 82 present, in the section trasversal to the axis of the cutting roller 1, a bridge-shaped structure, and they are supported at both ends. Particularly, in the embodiment according to FIGS. 1 and 2, each bridge-shaped blade-carrying member 80 is made unitarily of one piece with the skirt 2 of the cutting roller 1 and it is made from this skirt 2 by means of a through cavity 30 parallel to the axis of the cutting roller 1 and obtained, for example, by drilling a raised median portion 102 of the skirt 2 (FIG. 1). This cavity 30 is tubular and has a closed contour and may have any profile whatsoever. In the embodiment according to FIG. 2, the said cavity 30 is composed of two round holes 130 interspaced and parallel to each other and symmetrical with respect to the radial plane crossing the axis of the cutting roller 1 and the active edge of the blade 7. The said round holes 130 are interconnected by an eyelet 230 having a rectilinear profile with semicircular ends. This eyelet 230 is substantially oriented in the tangential direction and with the semicircular ends of its profile it intersects the two holes 130. The flat wall (its radially inner surface) of the eyelet 230, radially turned outwards, lies in substance in the same plane crossing the axes of the two holes 130. The diameter of the semicircular ends of the profile of the eyelet 30 is preferably longer than the one of the holes 130.

To achieve the desired level of flexibility of the bridge-shaped blade-carrying member 80, also the outer surface of the skirt 2 of the cutting roller 1 can be suitably profiled, preferably using a hob tool. In the embodiment according to FIG. 2, each blade-carrying member 80 externally presents a roof-shaped profile, defined by flat surfaces 31, symmetrically tilting with respect to the radial plane crossing the active edge of the blade 7 and the axis of the cutting roller 1. Between the roof-shaped outer profiles of every single blade-carrying member 80 grooves 32 are provided, defined by convex opposing surfaces which are connected to the corresponding tilting surfaces 31 of the roof-shaped profile. Preferably, the said conex lateral surfaces of grooves 32 present a circle-arc profile and are coaxial with the two nearby holes 130 of two adjacent cavities 30. The radial axis of symmetry of each groove 32 divides in half the angular distance between the two nearby holes 130.

By profiling in this way the outer surface of the skirt 2 of the cutting roller 1, the ends of the bridge-shaped blade-carrying members 80 are arched and comparatively thin in thickness, working like springs which allow for the elastic radial yield of the blade-carrying member and then of the blade 7. The flexibility of the bridge-shaped blade-carrying members 80 can be further increased, by opening holes or eyelets (not shown) in the respective bridges. These holes can also be arranged and shaped in such a way as to reduce the torsional strength of the bridge-shaped blade-carrying members in the area of their connection to the skirt 2 of the cutting roller 1.

Figure 3:
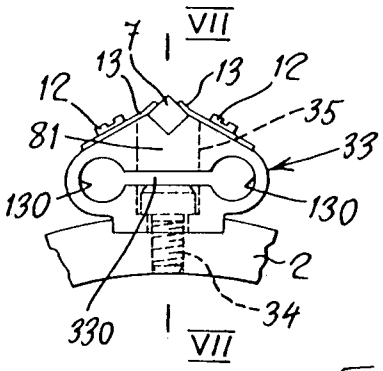
FIGS. 2 to 5 are cross-sectional views of different embodiments of the blade-carrying members according to the invention.
Figure 7:
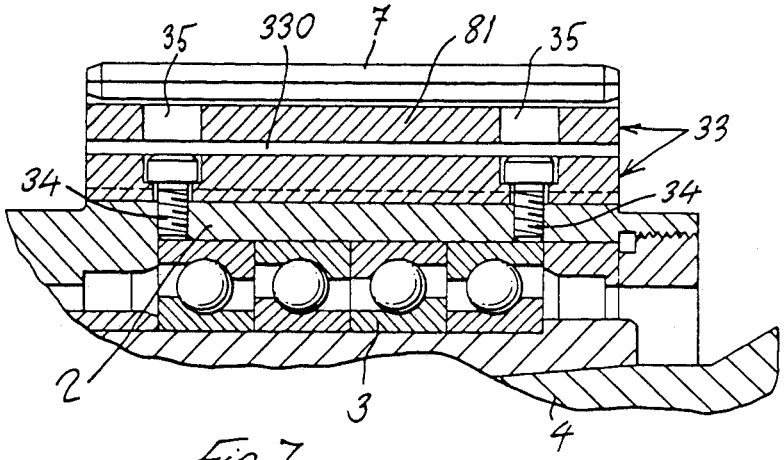

In the embodiment according to FIGS. 3 and 7, the bridge-shaped blade-carrying member 81 is no longer made from the skirt 2 of the cutting roller 1, but from an oblong block 33 that is added and fixed on the periphery of the skirt 2 of the roller 1. Also in this case, the bridge-shaped blade-carrying member 81 is obtained by opening in the block 33, by drilling and milling operations, a cavity consisting of two round holes 130, spaced apart from each other and connected by means of a rectilinear slit 330, opened at the level of the connection plane of the axes of the two holes in a plane extending perpendicularly to a plane through the axis of the roller and the cutting edge. Moreover, also in this case the blade-carrying member externally presents a roof-shaped profile laterally connected to the base of the block 33 by means of sides having a circle-arc profile concentric to the axes of the two holes 130, to obtain again arched and thinned parts for the connection of the bridge-shaped blade-carrying member 81 to the base of the block 33. The block 33 is secured to the skirt 2 of the cutting roller 1 by means of screws 34 set in the base of the block 33 and accessible through holes 35 provided in the above bridge-shaped blade-carrying member 81.

Figure 2:
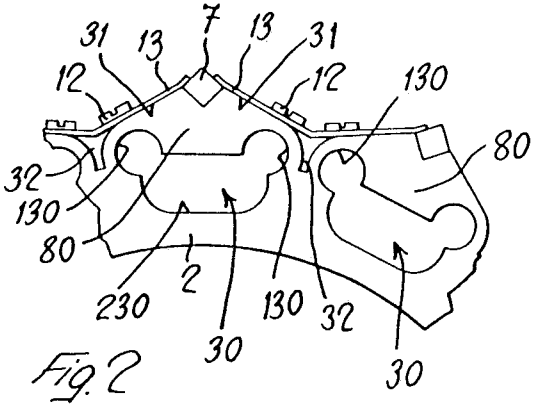
Figure 4:
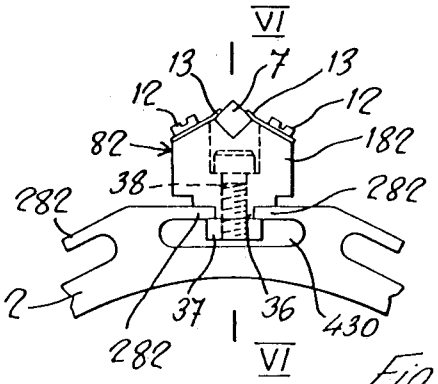
Figure 6:
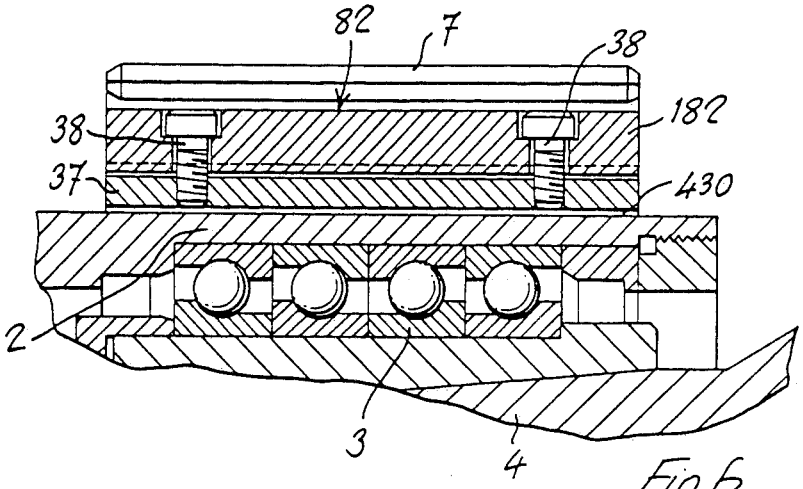
FIGS. 6 and 7 are longitudinal sectional views of the blade-carrying member following the lines VI—VI of FIG. 4 and VII—VII of FIG. 3.

The embodiment according to FIGS. 4 and 6 can be regarded as a mixed embodiment of those according to figure 2 and FIG. 3. In fact, in the embodiment according to FIGS. 4 and 6, the blade-carrying member 82 consists of an oblong block 182 which carries the blade 7 and is secured onto an elastically yieldable bridge 282-282 made from the skirt 2 of the cutting roller 1. Particularly, at the level of each blade-carrying member 82 the peripheral surface of the skirt 2 of the roller 1 is flattened and, by drilling and milling operations, an eyelet 430 parallel to the peripheral flattening is opened in the skirt 2, thereby obtaining the bridge 282-282.

In the shown embodiment, this bridge is divided, by means of a median longitudinal slit 36, into two cantilever tongues 282, between which a rib provided at the base of the block 182 fits. The block 182 is secured to the bridge 282-282 by means of a small gib 37 which is housed in the eyelet 430, and is secured from the inside by the two tongues 282, while it is connected to the block 182 by means of tightening screws 38.

Obviously, the median longitudinal slit 36 is not always necessary, that is to say, it is not always necessary that the bridge obtained by means of the eyelet 430 is divided into two individual cantilever tongues 282.

Figure 5:
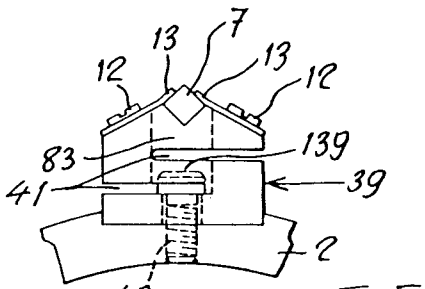

In the embodiment according to FIG. 5, the blade-carrying member 83 is made from an oblong block 39, added and fixed to the periphery of the skirt 2 of the cutting roller 1 by means of screws 40. Particularly, in this case, by means of a first lateral slit 41, a portion of cantilever support 139 is made from the block 39, and from the said portion the cantilever blade-carrying member 83 is made by means of a second lateral slit 41, parallel to the first one but opened on the opposite side of the block 39. A blade-carrying member is thereby obtained, which presents as a whole an S- or Z-shaped profile, i.e. a profile having two opposite projections.

We claim:

1. A device for dividing a continuous web of wrapping material into single successive sections of a same length, comprising:

a driving shaft having a longitudinal axis of rotation;

a rotary cutting roller having a skirt fixed on said shaft;

a peripheral radial blade having a cutting edge located outside the periphery of said roller, extending parallel to said axis; and a blade-carrying member for said blade fixed to said roller and fastened to said blade, and having a cavity radially inward of said blade with respect to said axis and extending through said blade-carrying member in a direction parallel to said axis so that said blade-carrying member is elastically yieldable in a radial direction through said cavity toward said axis.

2. A device as in claim 1, wherein said blade-carrying member and said skirt are unitarily formed.

3. A device as in claim 1, wherein said blade-carrying member is a separate piece fixed to said skirt.

4. A device as in claim 3, further comprising a fastening member fastening said blade-carrying member to said skirt.

5. A device as in claim 1, wherein said cavity is a slit formed in a plane extending perpendicularly to a radial plane extending through said axis and said cutting edge.

6. A device as in claim 1, wherein said cavity includes two spaced apart holes circular in cross section and a connecting cavity portion connecting said two holes, said cavity portion being formed of one of a slit and an eyelet.

7. A device as in claim 6, wherein said cavity portion is a slit formed in a plane extending parallel to said axis and connecting center axes of said holes.

8. A device as in claim 6, wherein said blade-carrying member has a wall portion having a planar surface defining a radially outward boundary of said connecting cavity portion formed in a plane extending parallel to said axis and connecting center axes of said holes.

9. A device as in claim 6, wherein said blade-carrying member has side portions on opposite sides thereof and partially bounding respective ones of said two holes, having arched profiles co-axial with said respective ones of two holes.

10. A device as in claim 1, wherein said blade-carrying member has radially outer surfaces sloping radially outwardly toward circumferentially opposite sides of said blade.

11. A device as in claim 1, wherein said blade-carrying member has a roof-shaped external profile.

12. A device for dividing a continuous web of wrapping material into single successive sections of a same length, comprising:

a driving shaft having a longitudinal axis of rotation;

a rotary cutting roller having a skirt fixed on said shaft;

a peripheral radial blade having a cutting edge located outside the periphery of said roller, extending parallel to said axis; and a blade-carrying member for said blade fastened to said blade, formed of a separate piece, said skirt having a cavity therein for each blade-carrying member, extending through said skirt in a direction parallel to said axis, said skirt having a portion over said cavity, said blade-carrying member being fixed to the portion of said skirt over said cavity so that said portion of said skirt is elastically yieldable in a radial direction through said cavity toward said axis.

13. A device as in claim 6, wherein said portion of said skirt has a longitudinal median slit for said cavity dividing said portion into two opposed cantilever tongues, said blade-carrying member having a rib extending into said slit, the device further comprising screws and a gib for said cavity, said gib being disposed in said cavity and said screws extending through said rib and into said gib to fix said rib in said slit and secure said blade-carrying member to said tongues.

14. A device for dividing a continuous web of wrapping material into single successive sections of a same length, comprising:

a driving shaft having a longitudinal axis of rotation;

a rotary cutting roller having a skirt fixed on said shaft;

a peripheral radial blade having a cutting edge located outside the periphery of said roller, extending parallel to said axis; and a blade-carrying member for said blade, said blade-carrying member being fixed to said skirt and fastened to said blade, being formed as a separate piece, and having a profile which has one of an S-shaped cross section and a Z-shaped cross section when viewed in an orientation with said cutting edge and said axis in a vertically extending plane.

15. A device as in claim 14, wherein said blade-carrying member has two parallel radially spaced slits circumferentially overlapping, extending through said blade-carrying member in directions parallel to said axis and opening into opposite sides of said blade-carrying member, thereby to define said profile.

16. A device for dividing a continuous web of wrapping material into single successive sections of a same length, comprising:

a driving shaft having a longitudinal axis of rotation;

a rotary cutting roller having a skirt fixed on said shaft;

a peripheral radial blade having a cutting edge located outside the periphery of said roller, extending parallel to said axis; and a blade-carrying member for said blade fixed to said roller and fastened to said blade, and having a tubular cavity with closed contour radially inward of said blade with respect to said axis and extending through said blade-carrying member in a direction parallel to said axis so that said blade-carrying member is elastically yieldable in a radial direction through said cavity toward said axis.

17. A device for dividing a continuous web of wrapping material into single successive sections of a same length, comprising:

a driving shaft having a longitudinal axis of rotation;

a rotary cutting roller having a skirt fixed on said shaft;

a peripheral radial blade having a cutting edge located outside the periphery of said roller, extending parallel to said axis; and a blade-carrying member for said blade fastened to said blade, formed of a separate piece, said skirt having a tubular cavity therein for each blade-carrying member, extending through said skirt in a direction parallel to said axis and having a closed contour, said skirt having a portion over said cavity, said blade-carrying member being fixed to the portion of said skirt over said cavity so that said portion of said skirt is elastically yieldable in a radial direction through said cavity toward said axis.

* * * * *